US006324879B1

(12) United States Patent
Kennedy

(10) Patent No.: US 6,324,879 B1
(45) Date of Patent: Dec. 4, 2001

(54) DEADBOLT COVER

(76) Inventor: Samuel Kennedy, 70-1929 Highway 97 South, Kelowna, British Columbia (CA), V1Z 2Z1

( * ) Notice: Subject to any disclaimer, the term of this patent is extended or adjusted under 35 U.S.C. 154(b) by 11 days.

(21) Appl. No.: 09/586,882

(22) Filed: Jun. 5, 2000

Related U.S. Application Data

(60) Provisional application No. 60/155,101, filed on Sep. 22, 1999.

(51) Int. Cl.[7] ..... E05B 13/00

(52) U.S. Cl. ..... 70/416; 701/417; 701/52; 701/54

(58) Field of Search ..... 70/416, 417, 52, 70/54, 55, 56, 2

(56) References Cited

U.S. PATENT DOCUMENTS

| | | | | |
|---|---|---|---|---|
| 3,158,017 | * | 11/1964 | Guze . | |
| 3,212,308 | * | 10/1965 | Eads . | |
| 4,127,967 | * | 12/1978 | Franzl | 49/171 |
| 4,159,838 | * | 7/1979 | Wilzig et al. | 292/150 |
| 4,201,069 | * | 5/1980 | Katayama et al. | 70/422 |
| 4,279,137 | * | 7/1981 | Cook | 70/416 |
| 4,413,492 | | 11/1983 | Strange | 70/416 |
| 4,673,202 | | 6/1987 | Willis | 292/162 |
| 4,827,745 | * | 5/1989 | Baugh | 70/416 |
| 4,838,059 | | 6/1989 | Johnson | 70/209 |
| 4,947,663 | * | 8/1990 | Yeager | 70/416 |
| 4,979,383 | | 12/1990 | Tully | 70/107 |
| 5,000,498 | | 3/1991 | Upchurch | 292/288 |
| 5,003,803 | * | 4/1991 | Richards | 70/416 |
| 5,007,263 | | 4/1991 | Taylor | 70/416 |
| 5,193,373 | | 3/1993 | Hunt | 70/416 |
| 5,201,202 | | 4/1993 | Kam | 70/168 |
| 5,313,812 | | 5/1994 | Eklund et al. | 70/416 |
| 5,327,632 | | 7/1994 | Moore | 29/401.1 |
| 5,421,074 | | 6/1995 | Moore | 29/401.1 |
| 5,515,704 | | 5/1996 | van Nguyen | 70/416 |
| 5,528,915 | * | 6/1996 | Percoco | 70/416 |
| 5,586,796 | * | 12/1996 | Fraser | 292/346 |
| 5,651,279 | * | 7/1997 | Berton et al. | 70/211 |
| 5,775,149 | * | 7/1998 | Small | 70/416 |
| 5,865,050 | | 2/1999 | Michaud et al. | 70/416 |
| 5,934,122 | * | 8/1999 | Edwards et al. | 70/416 |
| 6,145,358 | * | 11/2000 | Wu | 70/467 |

FOREIGN PATENT DOCUMENTS

| | | | |
|---|---|---|---|
| 2215006 | 10/1998 | (CA) | E05B/17/20 |

* cited by examiner

*Primary Examiner*—William A. Cuchlinski, Jr.
*Assistant Examiner*—Olga Hernandez
(74) *Attorney, Agent, or Firm*—Antony C. Edwards

(57) ABSTRACT

A deadbolt cover has a hollow housing mountable to a door. A deadbolt actuator knob on the door fits through a hole in the housing so as to be fully contained within the housing. A cover is slidably mountable into snug mating engagement within an opposite second hole in the housing so as to close the housing over the knob. The cover is releasably lockable onto the housing by a locking member mounted to the housing releasably engaging a cooperating female receiver in the cover.

4 Claims, 6 Drawing Sheets

DEADBOLT COVER

CROSS REFERENCE TO RELATED APPLICATION

This application claims priority from U.S. Provisional Patent Application No. 60/155,101 filed Sep. 22, 1999 titled Deadbolt Cover.

FIELD OF THE INVENTION

This invention relates to the field of devices for door locks, which devices are intended to inhibit unwanted access to the lock actuator mechanism, and in particular to removable covers mountable over lock actuators.

BACKGROUND OF THE INVENTION

Conventional deadbolt actuators for residential use when installed on a door have a knob on the inside of the door which may be manually turned so as to lock and unlock the deadbolt. The problem in the prior art is that many residential doors have glass inserts located near to the deadbolt so that a burglar only has to break the glass and reach inside the door to unlock the deadbolt.

SUMMARY OF THE INVENTION

In summary the deadbolt cover of the present invention includes a first or deadbolt knob housing mountable to a door so as to enclose a deadbolt knob. The housing has a rigid continuous perimeter wall. The perimeter wall has a base end on one end of the wall and an opposite second end on an opposite end of the wall. The base end of the perimeter wall has a first opening or aperture in it. The second end of the perimeter wall has a second opening or aperture in it. The perimeter wall and the base end define a central cavity. The first and second openings open into the central cavity. The first housing may be mounted to the door so as to journal a deadbolt actuator knob protruding from the door through the first opening into the central cavity so as to fully contain the knob within the first housing.

A cover is provided which is slidably mountable into snug mating engagement with the first housing so as to close the second opening. The cover is releasably lockable onto the first housing by means of a male locking member on the housing releasably engaging a cooperating female receiver such as a groove, channel, aperture, detent or the like in the cover.

In one embodiment, not intended to be limiting, the locking member is resiliently urged by a resilient actuator into locking registration with the female receiver in the cover. The locking member may be mounted to a plunger slidably mounted to the housing. The plunger may be mounted to the locking member, for example, rigidly or by means of a mechanical linkage or the like, for pulling the locking member from registration with the female receiver against the return biasing force of the resilient actuator, such as a spring, when the plunger is manually translated relative to the first housing by a user pulling on the plunger. The plunger is slidable between a locking position wherein the locking member is engaged within the female receiver, and an unlocking position wherein the locking member is removed from engagement within the female receiver.

A telescopically translatable hollow second housing such as a collar, tube or the like is telescopically mounted to the first housing for telescopic sliding relative to the first housing. The plunger is slidably journalled through the hollow second housing. The second housing is telescopically translatable from a plunger disabling position to a plunger access position against the return biasing force of a second resilient return means wherein, when in the plunger disabling position, an outermost end of the plunger is enclosed within the second housing, and wherein, in the plunger access position, the outermost end of the plunger is exposed so as to facilitate manual grasping and pulling of the plunger by a user. Thus a first hand of the user may, firstly, depress the second housing so as to translate the second housing into the plunger access position and, secondly, then grasp the outermost end of the plunger. The plunger may then be translated into the unlocking position. A second hand of the user may then subsequently grasp and remove the cover from the first housing so as to expose the deadbolt knob in the central cavity whereby the user may gain access to the deadbolt knob for actuation of the deadbolt mounted in the door.

DETAILED DESCRIPTION OF PREFERRED EMBODIMENTS

Figure 1:
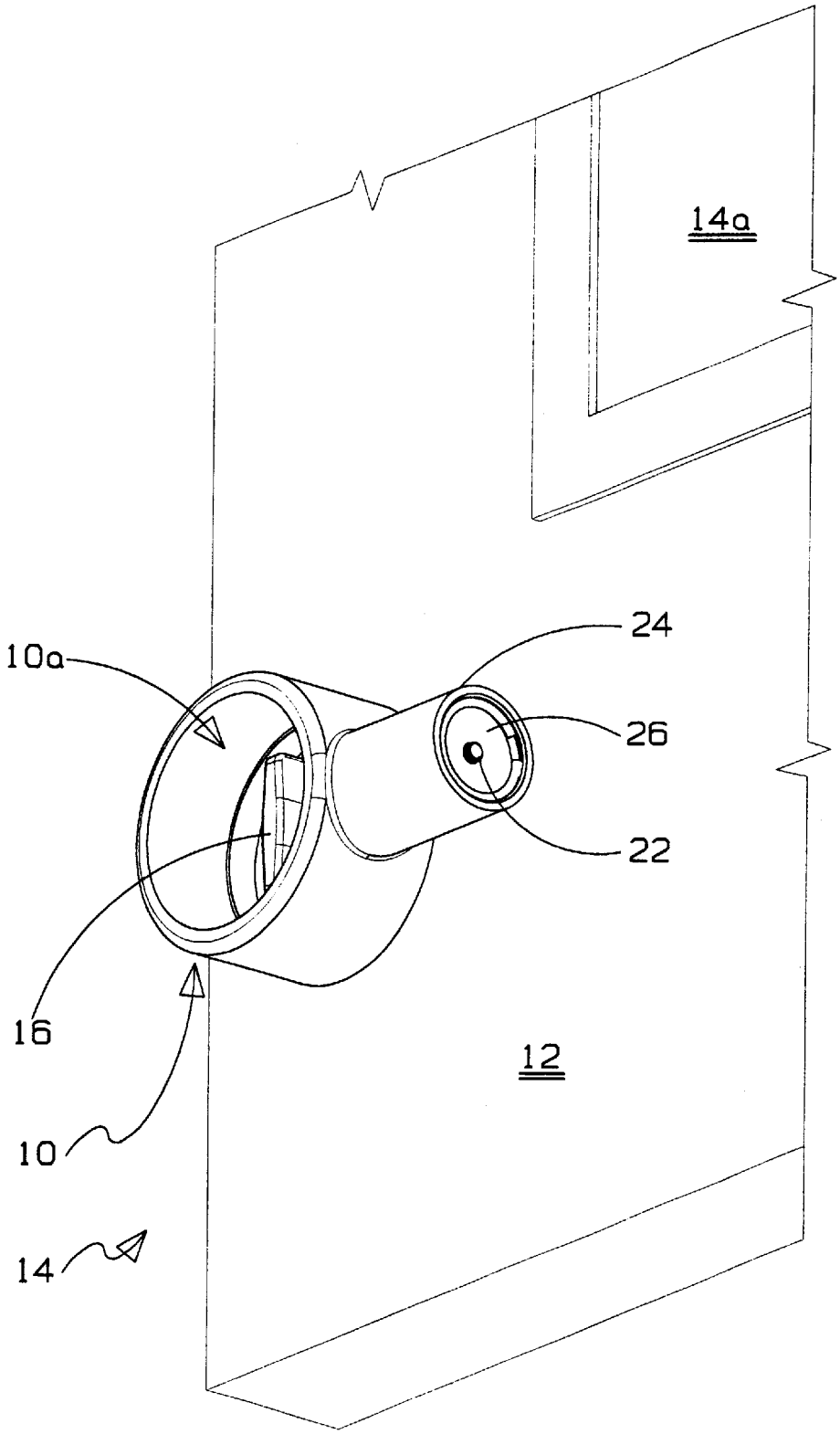
FIG. 1 is, in front perspective view, the deadbolt knob of housing of the deadbolt cover of the present invention.
Figure 2:
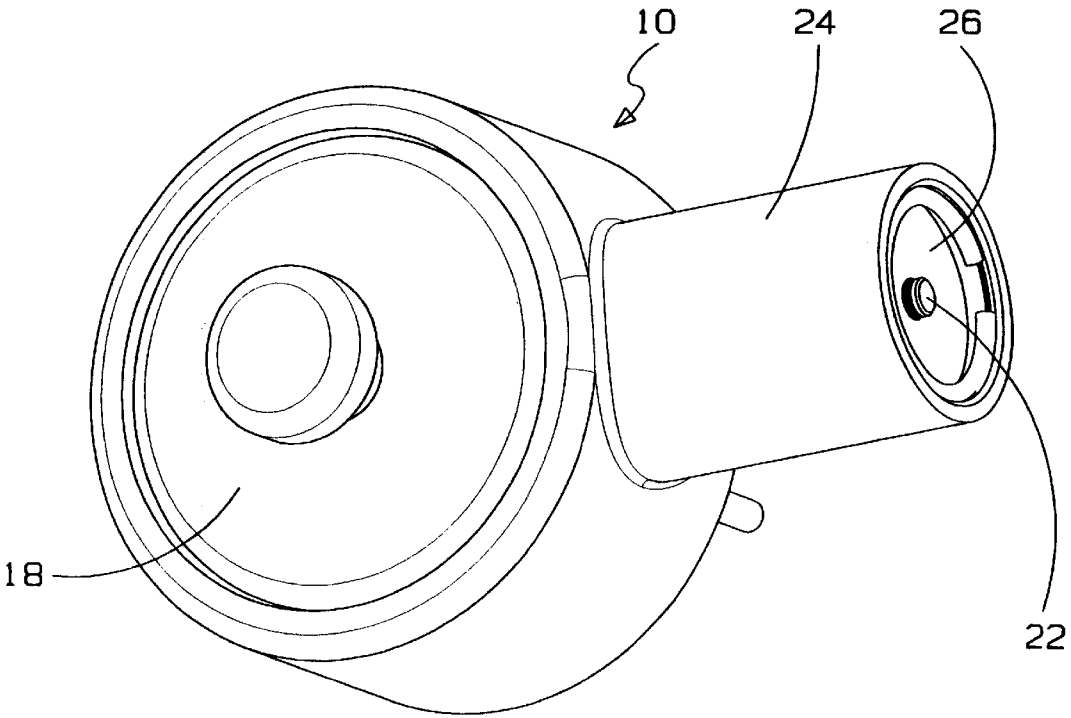
FIG. 2 is the deadbolt knob housing of FIG. 1 with the housing cover installed.
Figure 3:
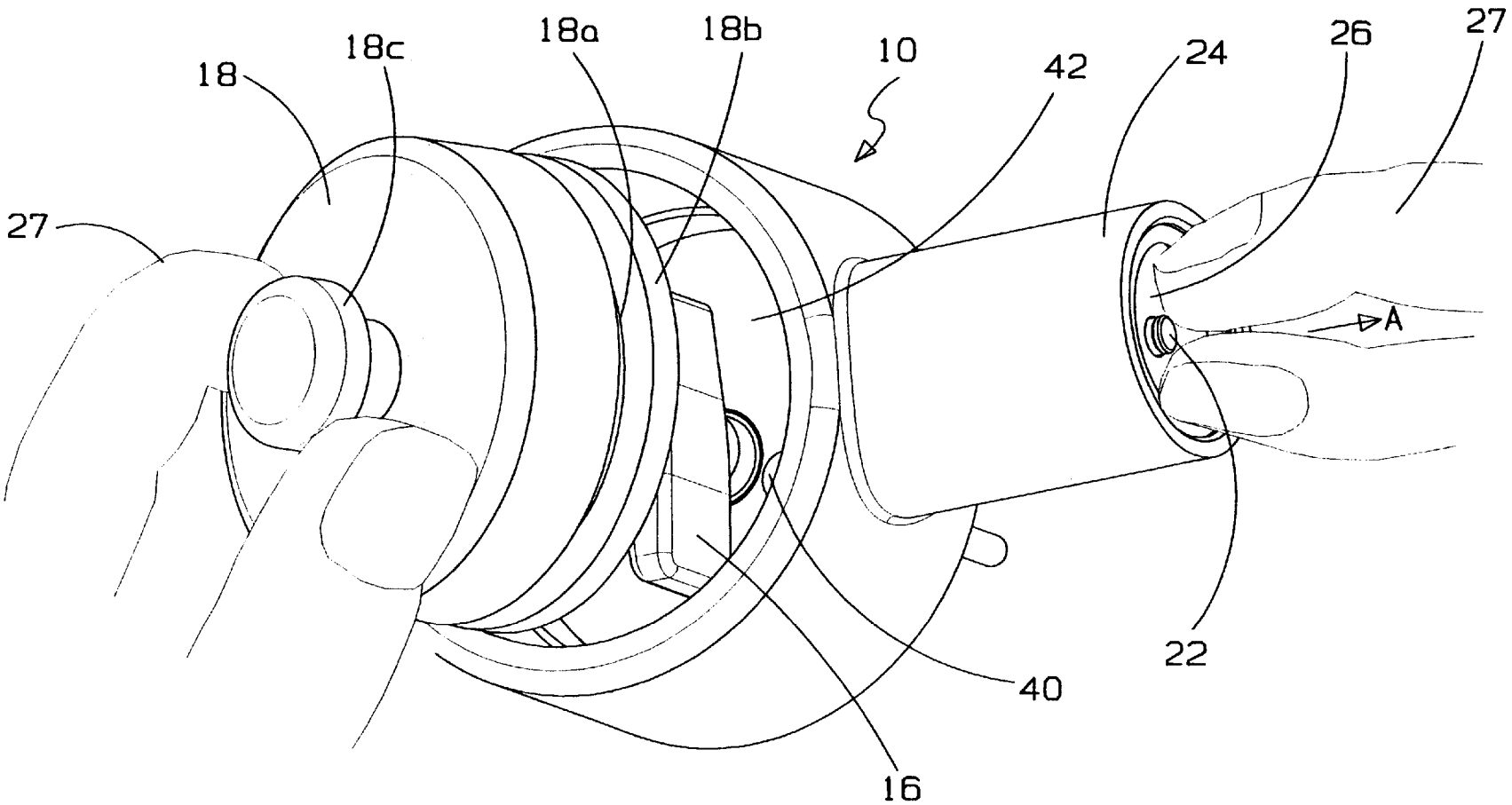
FIG. 3 is, in front perspective view, a user operating the cover locking mechanism of the deadbolt cover of the present invention.
Figure 4:
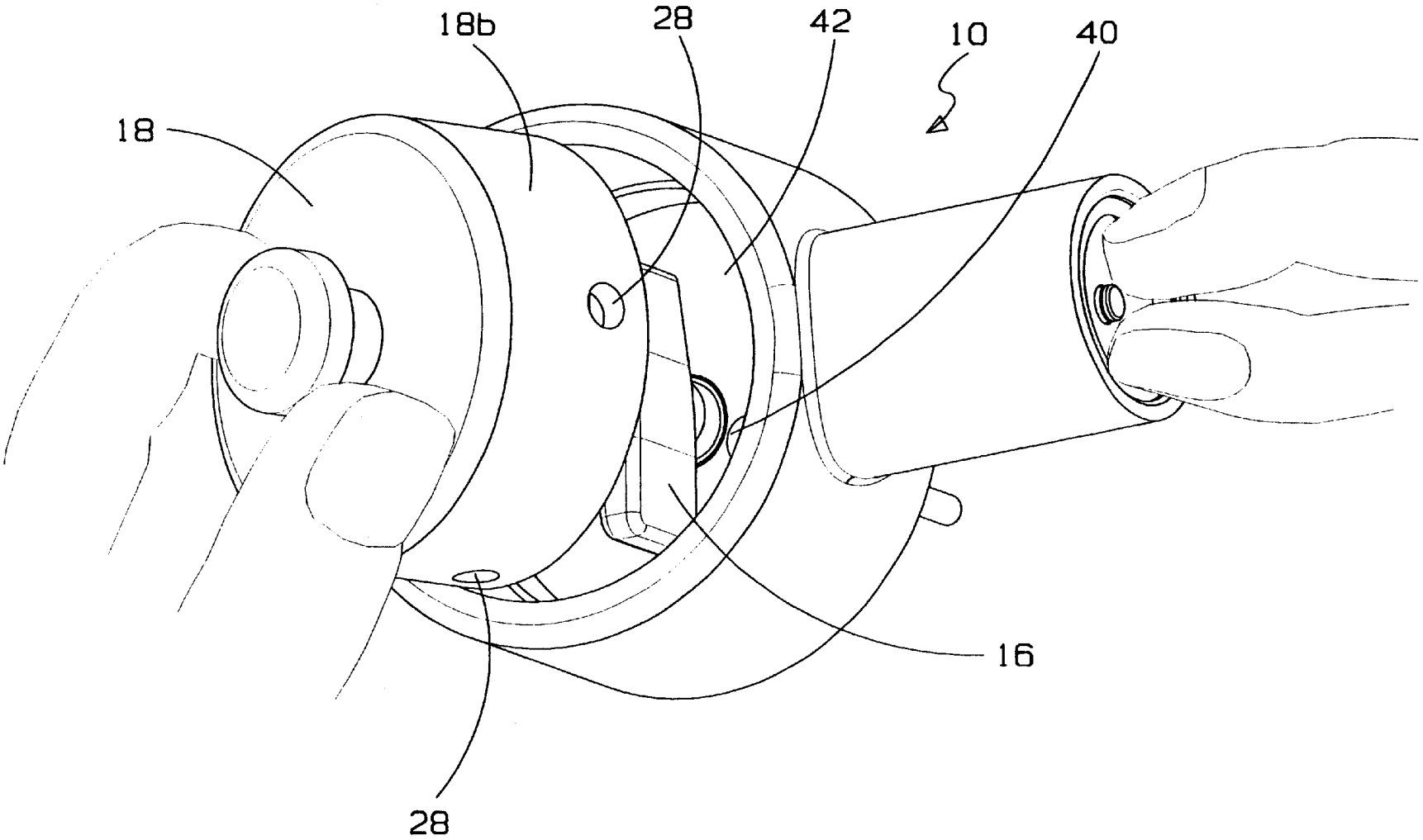
FIG. 4 is the view of FIG. 3 in an alternative embodiment of the present invention.
Figure 5:
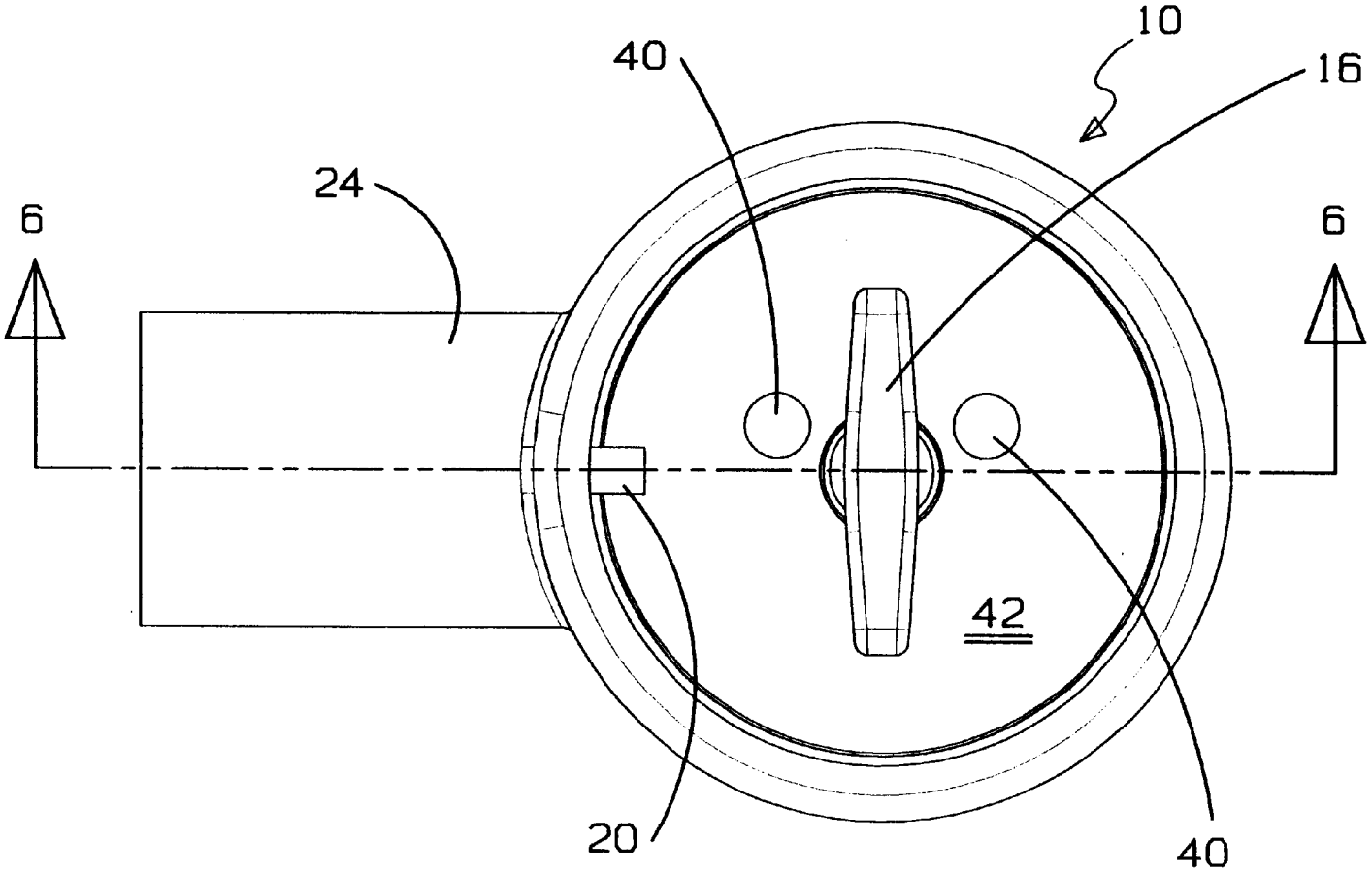
FIG. 5 is, in plan view, the deadbolt knob of housing of the deadbolt cover of FIG. 4 with the cover removed.
Figure 6:
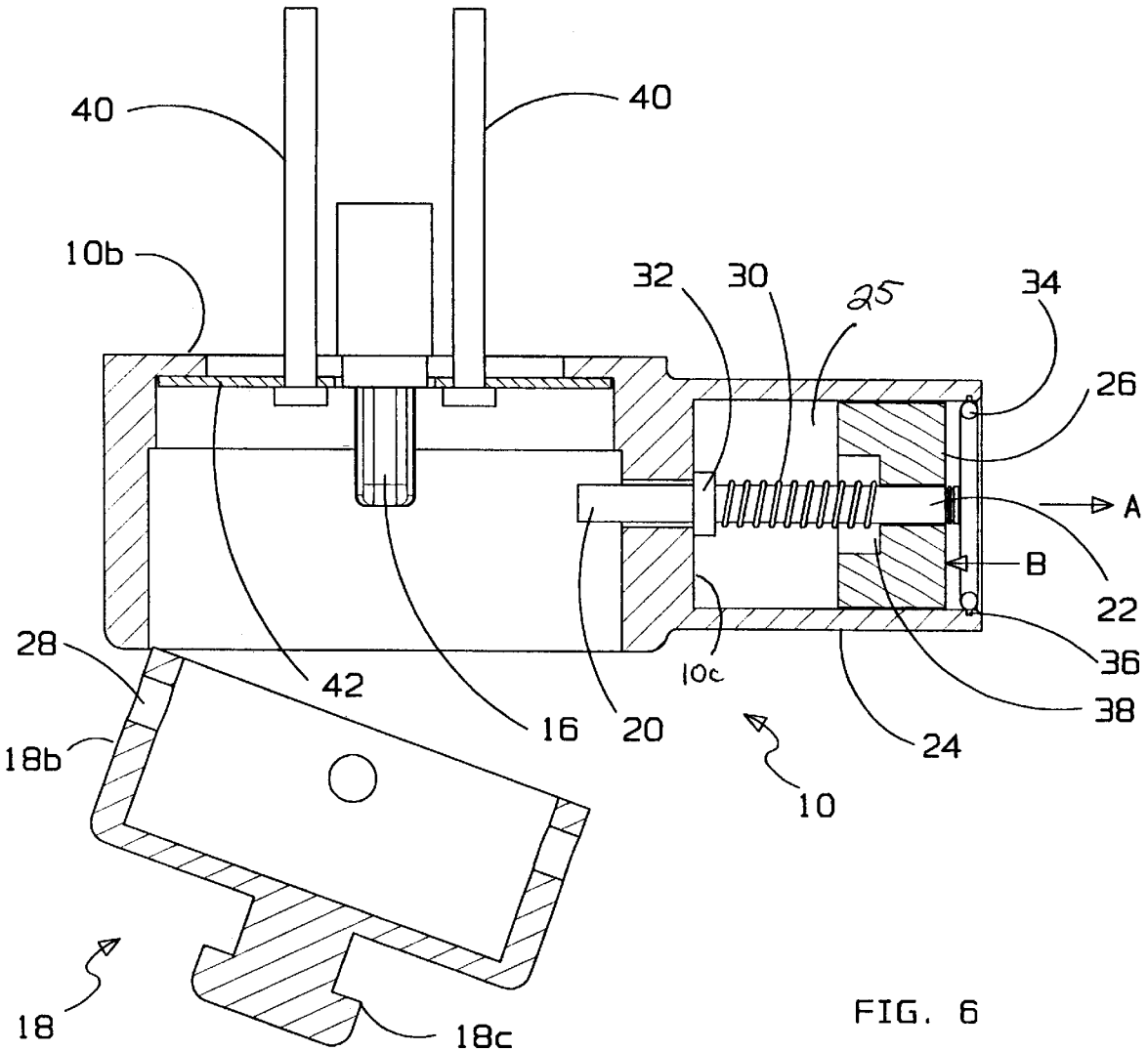
FIG. 6 is a sectional view along line 6—6 in FIG. 5.

In the embodiment of FIGS. 1–3, an annular housing 10 is mounted to the inside surface 12 of a door 14 so as to enclose within housing 10 knob 16 of a deadbolt doorlock (not shown) mounted in the door in a conventional manner. Cover 18 is releasably mountable to housing 10 by a snug sliding fit into cavity 10*a* in housing 10. Cover 18 has in one embodiment an annular groove 18*a* around its rim 18*b*. Groove 18*a* mates with a spring loaded pin 20 seen in FIG. 6. Pin 20 is slidably mounted through a hole in the side wall of housing 10. Pin 20 is rigidly and co-axially mounted to an inner-most end of plunger 22. Plunger 22 may be manually pulled outwardly in direction A from a position recessed within outer collar or housing 24 on housing 10 so as to pull pin 20 from mating engagement with groove 18*a* Plunger 22 is slidably journalled through a bore in an inner collar 26. The bore is co-axial with the longitudinal axis of bore 25 in hollow outer collar 24. Inner collar 26 slides along the bore of hollow collare 24 between a split ring 34 mounted in annular groove 36 in the distal end of collar 24 and the corresponding side wall portion 10*c* of housing 10.

In order to pull plunger 22 from within outer collar 24, firstly inner collar 26, which is resiliently telescopically mounted within bore 25 of collar 24, is depressed in a direction opposite to direction A, shown as direction B, so as to slide inwardly along the surface of bore 25. The end of plunger 22 is thereby exposed. User 27 may then grasp the exposed end of plunger 22. Plunger 22 may then be pulled outwardly from collar 24 in direction A removing pin 20 from its engagement with groove 18*a*. Cover 18 may be then removed from within cavity 10*a* by user 27 grasping and pulling cover handle 18*c* with the user's other hand.

Thus it may be seen that in order to gain access to knob 16, user 27 must use both hands. This makes it very difficult for a burglar who is trying to break-and-enter by breaking glass pane 14*a*. The burglar must break the glass in glass pane 14*a*, reach through the glass pane with both hands, and thereafter operate the locking mechanism so as to remove cover 18 to gain access to the deadbolt knob 16. Only once this is done may the door be opened.

In the second embodiment of FIGS. 3–6, instead of groove 18*a*, a hole 28 is formed through or in rim 18*b* of cover 18. Pin 20 engages hole 28 to releasably lock cover 18 onto housing 10.

In both embodiments, plunger 22 may be pulled in direction A from within collar 24 against the return biasing force of helical coil spring 30. Pulling plunger 22 in direction A compresses spring 30 between ring 32 on plunger 22 and annular bearing flange 38 rigidly mounted on or formed in inner collar 26. Inner collar 26 slides in direction B, opposite to direction A, against the return biasing force of spring 30. Again, spring 30 is compressed between ring 32 and annular bearing flange 38.

Housing 10 is, in both embodiments, mounted onto the inner surface 12 of door 14 by means of bolts or screws 40. Bolts or screws 40 sandwich mounting base plate 10*b* of housing 10 between deadbolt knob mounting plate 42 and surface 12 of door 14.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A deadbolt cover comprising:

a first housing mountable to a door, said first housing having a rigid continuous perimeter wall, said perimeter wall having a base end and an opposite second end, a first aperture in said base end and a second aperture in said second end opening into, so as to cooperate with, a central cavity defined by said perimeter wall, said base end and said second end, said first housing mountable to said door so as to journal a deadbolt actuator knob protruding from said door through said first aperture into said central cavity and so as to fully contain said knob within said first housing, a cover slidably mountable into snug mating engagement with said first housing so as to close said second aperture, said cover releasably lockable onto said first housing by means of a locking member mounted to said first housing releasably engaging a cooperating female receiver in said cover.

2. The deadbolt cover of claim 1 further comprising a resilient actuator, said locking member resiliently urged by said resilient actuator into locking registration with said female receiver in said cover, and a plunger, slidably mounted to said housing and mounted to said locking member, an exposed end of said plunger for grasping and pulling by a user so as to pull said locking member from said locking registration with said female receiver against a return biasing force of said resilient actuator as said plunger is manually translated relative to said first housing by the user.

3. The deadbolt cover of claim 2 wherein said plunger is slidable between a locking position, wherein said locking member is in said locking registration with said female receiver, and an unlocking position wherein said locking member is removed from said locking registration with said female receiver.

4. The deadbolt cover of claim 3 further comprising a telescopically translatable hollow second housing for telescopic sliding relative to said first housing, wherein said plunger is journalled through a bore in said second housing, said second housing telescopically translatable from a plunger disabling position to a plunger access position against the return biasing force of said resilient actuator wherein when in said plunger disabling position said exposed end of said plunger is substantially enclosed within said bore in said second housing, and wherein in said plunger access position said exposed end of said plunger is filly exposed to the user so as to facilitate manual grasping of said plunger by the user, wherein a first hand of the user may slide said second housing inwardly towards said first housing so as to translate said second housing into said plunger access position and subsequently grasp said exposed end of said plunger so as to then translate said plunger into said unlocking position, wherein a second hand of the user may subsequently remove said cover from said first housing so as to expose said deadbolt knob in said central cavity, whereby the user may gain access to said deadbolt actuator knob for actuation of a deadbolt mounted in the door.

* * * * *